United States Patent [19]

Andersson

[11] 4,392,444

[45] Jul. 12, 1983

[54] HIGH STABILITY TRIMARAN

[76] Inventor: Lars G. Andersson, Lufttrycksgatan 3 BV, S-417 40 Goteborg, Sweden

[21] Appl. No.: 222,877

[22] Filed: Jan. 6, 1981

[30] Foreign Application Priority Data

Jan. 10, 1980 [SE] Sweden ..... 7906031

[51] Int. Cl.[3] ..... B63H 35/00

[52] U.S. Cl. ..... 114/39; 114/61; 114/126

[58] Field of Search ..... 114/39, 61, 91, 126, 114/123

[56] References Cited

U.S. PATENT DOCUMENTS

| | | | |
|---|---|---|---|
| 3,610,190 | 10/1971 | Palmer | 114/39 |
| 3,626,883 | 12/1971 | Ellis | 114/61 |
| 3,820,489 | 6/1974 | Wortmann | 114/39 |
| 3,937,166 | 2/1976 | Lindsay | 114/61 |
| 3,960,102 | 6/1976 | Davy | 114/61 |
| 3,996,874 | 12/1976 | Winch | 114/61 |
| 4,172,426 | 10/1979 | Susman | 114/61 |

FOREIGN PATENT DOCUMENTS

| | | | |
|---|---|---|---|
| 1343573 | 1/1974 | United Kingdom | 114/39 |

*Primary Examiner*—Trygve M. Blix
*Assistant Examiner*—Jesús D. Sotelo
*Attorney, Agent, or Firm*—Cushman, Darby & Cushman

[57] ABSTRACT

A trimaran which includes a main hull, starboard hull, and port hull, has positive stability for up to about 130° inclination of the main hull. The starboard and port hulls are pivotally mounted to the main hull, and the mast is mounted to the main hull for pivotal movement about an axis generally parallel to the axes about which the starboard and port hulls are pivotal. Shrouds attach the mast to the starboard and port hulls, and springs may operatively connect the shrouds to the starboard and port hulls, respectively, so that the effective lengths thereof are variable. Springs, and stops, are connected between the main hull and the starboard and port hulls, respectively, to prevent pivotal movement relative to each other unless the wind exceeds a predetermined value.

10 Claims, 8 Drawing Figures

STRAIGHTENING-UP MOMENT (Kpm)
3500
3000
B
C
D
64
65
66
Y
X
A
Z
62
60
10
30
50
70
90
110
130
150
180
INCLINATION ANGLE, θ (IN DEGREES)

STRAIGHTENING-UP MOMENT (Kpm)
3500
3000
B
C
D
64
68
Y
X
Z
62
60
A
66
10
30
50
70
90
110
130
150
180
INCLINATION ANGLE, θ (IN DEGREES)

HIGH STABILITY TRIMARAN

BACKGROUND AND SUMMARY OF THE INVENTION

The present inventions relates to a sailboat of the type normally referred to as a trimaran, having a main hull with smaller starboard and port hulls on either side thereof. Such sailboats conventionally include one or more masts mounted on the main hull with shrouds often fixed at or near the rail of the side hulls. Such sailboats normally have very good sailing properties, particularly for ocean racing, since a great stiffness relative to weight is obtained with the three-hull configuration. A great initial stiffness gives a smaller inclination, and thus better comfort. Further, such a construction allows each hull to be designed without requiring that it remain stable, allowing use of narrow hulls with low resistance. The bottoms of the side hulls are conventionally positioned vertically above the main hull bottom so that when the sailboat is upright with the wind from the stern, or in light winds, the boat sails on the main hull alone, thereby providing low resistance. Since no ballast is necessary, the trimaran also can be made unsinkable.

While trimarans have many advantages, there is one significant drawback associated with conventional trimarans. A conventional trimaran reaches its greatest stability at 20°–35° inclination, and at larger inclinations the stability steadily decreases down to zero at about 80° inclination. Thus, trimarans can capsize due to the impact of wind or waves, and are not self-righting, so that once capsized they remain upside down.

Various proposals have been suggested in the art for minimizing the adverse consequences associated with a trimaran's lack of self-righting ability. For instance, in Swedish Pat. No. 383,497, a trimaran with safety rigging is proposed which provides a mast which can move relative to the main hull. However, the movable mast alone does not lower the risk of capsizing due to waves.

In French Pat. Nos. 1,505,692 and 1,574,766 proposals are made for mounting the starboard and port hulls so that they are movable relative to the main hull. While such an arrangement provides better stability, sailing comfort in very hard winds is relatively poor, and stability still is not as good as desired.

According to the present invention, a trimaran is provided that overcomes the stability and other problems associated with conventional trimarans and the prior proposed trimarans discussed above. The trimaran according to the present invention is self-righting, and the angle of inclination of the main hull is minimized. In fact, positive stability of the trimaran according to the present invention is provided up to about 130° inclination of the main hull, compared to 80° inclination of the main hull for conventional trimarans.

According to the trimaran of the present invention, means are provided for operatively attaching the starboard and port hulls to the main hull so that each of the starboard and port hulls is pivotal with respect to the main hull about an axis generally parallel to the direction of elongation of the main hull. Further, means are provided for pivotally mounting the mast to the main hull so that the mast is pivotal about an axis substantially parallel to the axes about which the starboard and port hulls are pivotal, and shroud means are provided for operatively attaching the mast to the starboard and port hulls. At least one spring device is pivotally connect at one end thereof to the main hull and at the other end thereof to the each of the starboard and port hulls, and a stop means is provided for stopping the movement of the starboard or port hulls towards the main hull at a predetermined desired position. The force applied by the spring devices are of sufficient magnitude to prevent substantial pivotal movement of the starboard and port hulls with respect to the main hull in normal fresh winds, while such pivotal movement is allowed in winds stronger than normal fresh winds. If desired, a resilient device may be operatively attached to each shroud, such as between the shroud and the side hull with which it is associated, to allow variation in the length thereof during relative movement of the mast with respect to the main hull.

In actual comparative testing, and in comparative mathematical analyses, of the trimaran according to the present invention and conventional and prior proposed trimarans, the trimaran according to the present invention has greatly improved stability and sailing comfort, and such stability and sailing comfort are achieved with a relatively minimal increase in the cost of construction.

It is the primary object of the present invention to provide a trimaran with maximum stability. This and other objects of the invention will become clear from an inspection of the detailed description of the invention, and from the appended claims.

DETAILED DESCRIPTION OF THE DRAWING

Figure 1:
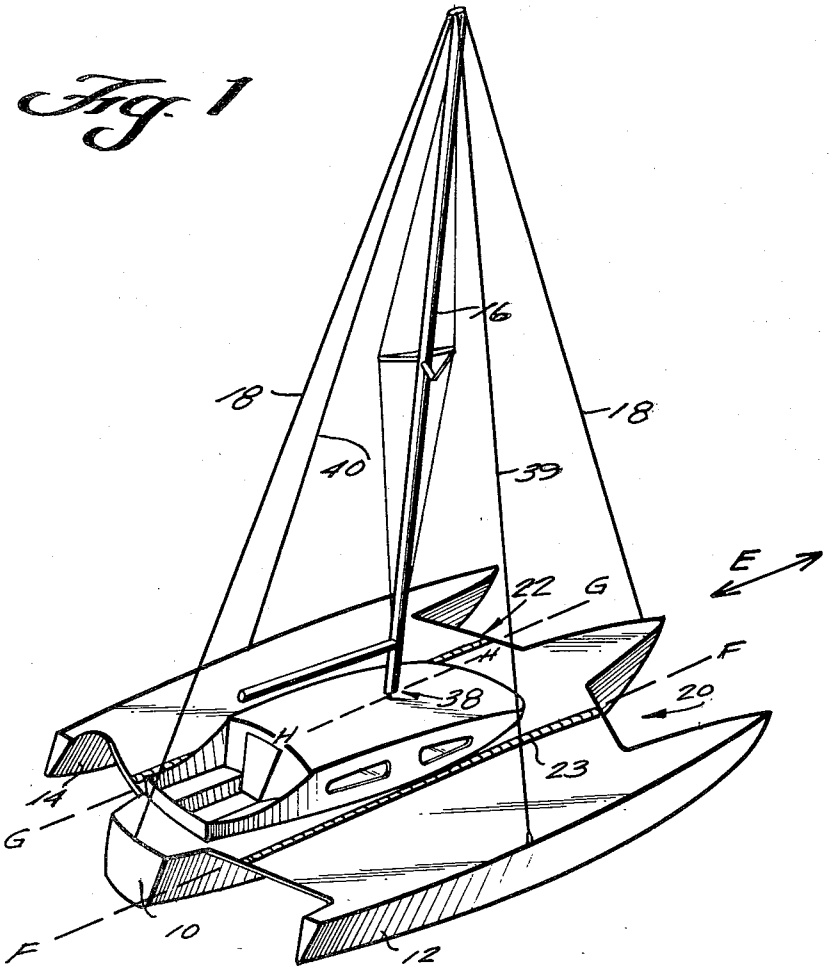
FIG. 1 is a top perspective view of an exemplary trimaran according to the present invention.

An exemplary trimaran according to the present invention is illustrated in FIG. 1. The trimaran includes a main hull 10 elongated in dimension E, and a pair of side hulls. The side hulls include starboard hull 12 and port hull 14, each disposed generally parallel to the main hull 10. A mast 16 is mounted to the main hull 10, and is stabilized by stays 18.

According to the present invention, means are provided for attaching the components 10, 12, 14 and 16 with respect to each other so that the trimaran is self-righting and the angle of inclination of the main hull is minimized. Such attaching means include means for operatively attaching the starboard and port hulls 12, 14 to the main hull 10, means for operatively attaching the mast 16 to the main hull 10, and means for operatively attaching the mast 16 to the starboard and port hulls 12, 14.

Figure 2:
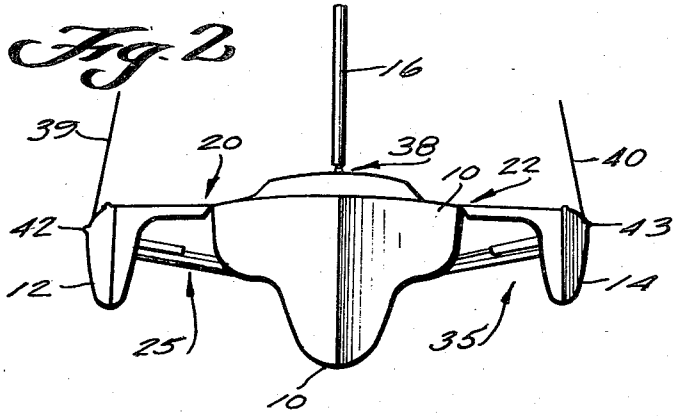
FIG. 2 is a front view of the trimaran of FIG. 1.
Figure 3:
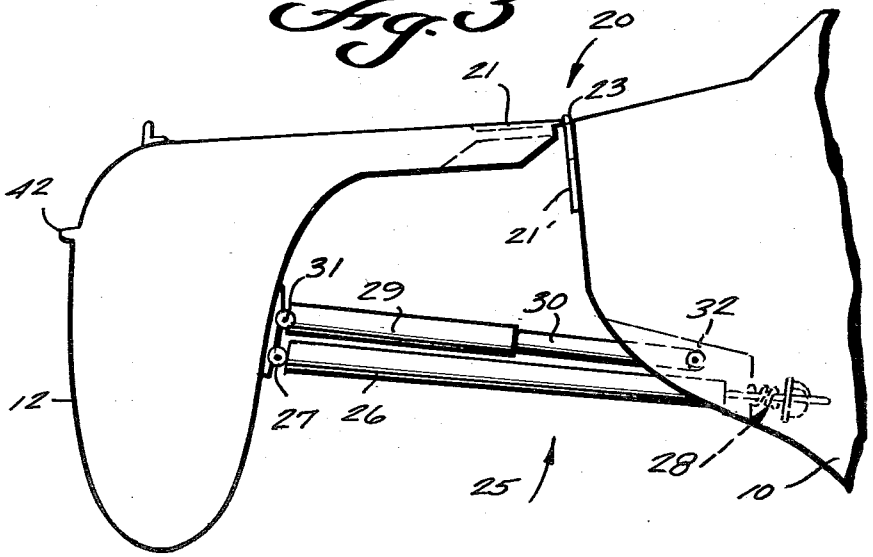
FIG. 3 is a detailed front view of the starboard side hull of the trimaran of FIG. 2, and the interconnections thereof to the main hull.

With particular reference to FIGS. 1 through 3, the means for attaching the starboard and port hulls 12, 14 to the main hull 10 comprise means, shown generally at 20, 22, for pivotally mounting the starboard and port hulls 12, 14, respectively to the main hull 10 along opposite sides of the main hull so that the starboard and port hulls 12, 14 are pivotal about axes F-F, G-G, respectively, with respect to the main hull 10. The axes F-F and G-G are generally parallel to the dimension of elongation E of the main hull 10. They need not be exactly parallel, however, depending upon the boat design, expected sea properties, or the like. As illustrated most clearly in FIGS. 2 and 3, the means 20 include plates 21, 21' attached to the starboard hull 12 and main hull 10, respectively, by suitable fasteners, and interconnected by a hinge 23 or the like. The attaching means 22 are similar. Further, the attaching means 20 also comprise resilient means for applying a force to the starboard and port hulls, the resilient means being indicated generally by reference numeral 25 in FIGS. 2 and 3.

One exemplary form that the resilient means 25 may take is designed to apply a force to the side hull (12, 14) with which it is associated of sufficient magnitude to prevent substantial pivotal movement about its axis (F-F, G-G) in normal fresh winds, while providing pivotal movement in winds stronger than normal fresh winds. The resilient means 25 also apply a force which increases as the side hull with which it is associated pivots about its axis. For instance, the resilient means 25 may comprise a spring device 26, such as a spring of metal or rubber, pivotally attached at one end 27 thereof to the side hull 12, and pivotally mounted at the other end 28 thereof to the main hull 10. Stop means, such as telescopic rods 29 and 30, also are provided for stopping the movement of the side hull 12 toward the main hull 10 at the predetermined desired position illustrated in FIGS. 2 and 3. Rod 29 is pivotally connected at end 31 thereof to the side hull 12, and rod 30 is pivotally connected at end 32 thereof to the main hull 10, while the opposite ends of the rods 29, 30 telescopically engage each other, being disposed in their stopping position in FIG. 3. The resilient means 35 associated with port hull 14 is identical to the resilient means 25.

Means for operatively attaching the mast 16 to the main hull 10 comprise means, such as hinge connection 38, for pivotally mounting the mast 16 to the main hull 10 so that it is pivotal about an axis H-H substantially parallel to the axes F-F and G-G. The means for operatively attaching the mast 16 to the starboard and port hulls 12, 16, comprise shroud means, such as shrouds 39 and 40. Shroud 39 is connected at one end thereof to a top portion of mast 16, and at the other end thereof to an attachment device 42 (see FIGS. 2 and 3) on the portion of port hull 12 most remote from main hull 10, while shroud 40 is connected at one end thereof to a top portion of mast 16 and at the other end thereof to an attachment device 43 (see FIG. 2) on a portion of port hull 14 most remote from main hull 10.

For the trimaran according to the present invention, described above, at increasing wind at first the leeward side hull will move upwardly, and at somewhat a later time the windward side hull will move upwardly. In order to allow the mast 16 to start tilting before the leeward side hull starts to move up, (which decreases the inclination of the main hull 10 somewhat), means for providing variation in the length of each of the shrouds 39, 40 during relative movement of the mast 16 with respect to the main hull 10 are utilized. Such means take the form of resilient devices, such as coil springs 45, 46 (see FIG. 5) operatively attached to the respective shrouds 39, 40, and applying a force tending to provide a given predetermined length of each shroud plus resilient device. In the embodiment illustrated in FIG. 5, springs 45, 46 are connected directly to the attachment devices 42, 43, respectively, at one end thereof, and at the other end thereof to the shrouds 39, 40, respectively, although the springs 45, 46 or their equivalents may be connected in other manners to provide the desired results.

While the invention has been described with respect to only one mast 16, one set of shrouds 39, 40, etc., it is to be understood that the scope of the invention is not so limited, and a wide variety of numbers of masts, shrouds, and the like, and relative orientations therebetween, may be provided.

Figure 4:
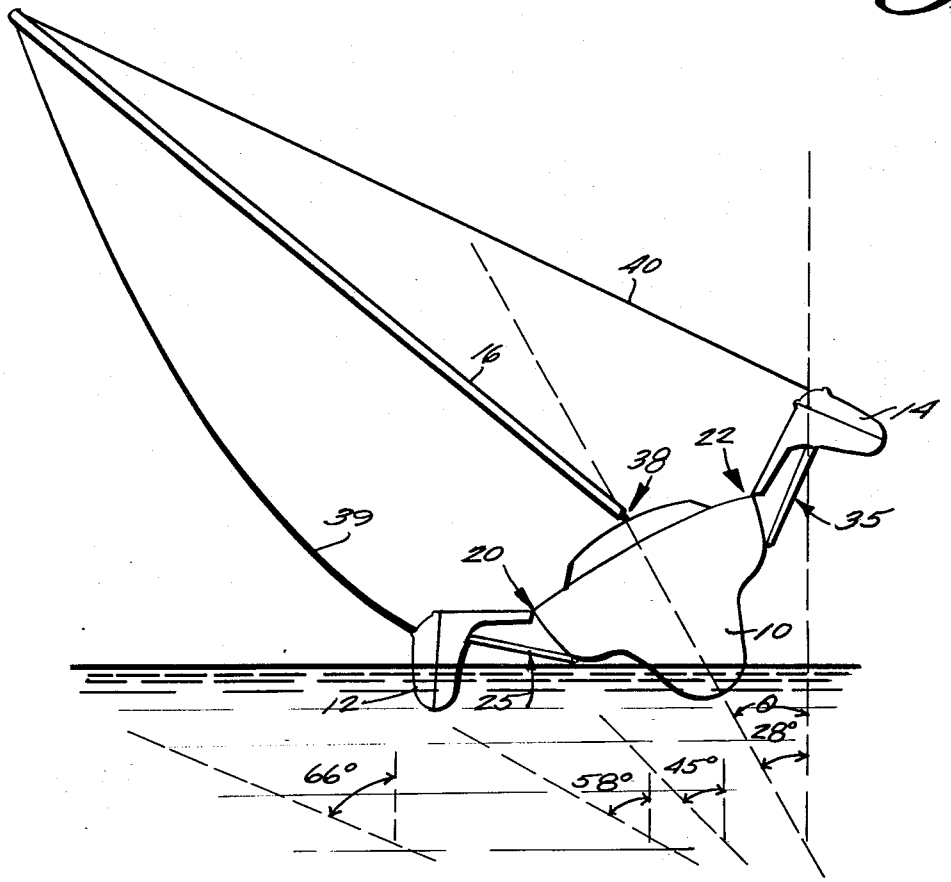
FIG. 4 is a front schematic view illustrating the trimaran of FIG. 1 in use when encountering extremely hard winds.

As a result of the particular interconnections between the side hulls 12, 14, the main hull 10, and the mast 16, as described above, the trimaran according to the present invention has positive stability up to about 130° inclination of the main hull 10, while that for a normal trimaran is about 80°. In FIG. 4, a typical inclination of the main hull 10 and mast 16 when the boat is subjected to extremely hard winds is illustrated. As can be seen, both the starboard and port hulls 12, 14, respectively, pivot about their pivotal connections 20, 22, respectively, while the mast 16 also pivots about its pivotal connection 38. The shroud 40 is taut, while the shroud 39 is slack. The resilient means 25, 35 allow the relative pivotal movements of the side hulls 12, 14, but apply a force tending to return the hulls to their original position (FIG. 2). As can be seen in FIG. 4, the angle of inclination $\theta$ of the main hull 10 with respect to the vertical is only 28° while the mast inclines 50° with respect to the vertical. Thus, the mast inclines 22° more than the main hull (50° minus 28°=22°). In FIG. 4, the port hull 14 is the windward hull, while the starboard hull 12 is the leeward hull.

FIG. 4 also schematically illustrates the angles of inclination of the hull of various other types of boats when subjected to the same wind loading. For instance, a corresponding keelboat would have an angle of inclination of 58°, a conventional trimaran 66°, and a proposed trimaran such as illustrated in French Pat. No. 1,505,692 an angle of inclination of 45°.

Figure 6:
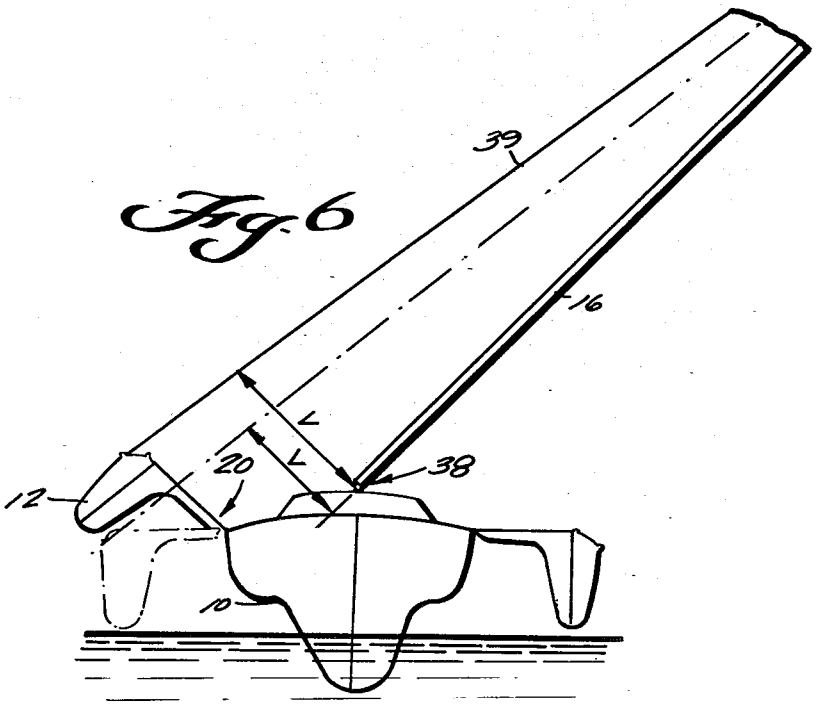
FIG. 6 is a front view of an exemplary trimaran according to the present invention comparing differences in the resulting lever arm as a result of the mast tilting with a trimaran with pivotal mast and "elastic" shrouds (dotted)

FIG. 6 schematically illustrates the increase in lever arm size provided according to the invention by making the side hulls and the mast pivotal compared to a trimaran with pivotal mast and "elastic" shrouds (dotted). When the mast 16 reaches its final tilted position, it will be loaded in proportion to the maximum stability of the boat and the smaller the lever arm L which the shroud (39 in FIG. 6) makes with the pivotal connection 38, the greater the loading will be.

Figure 7:
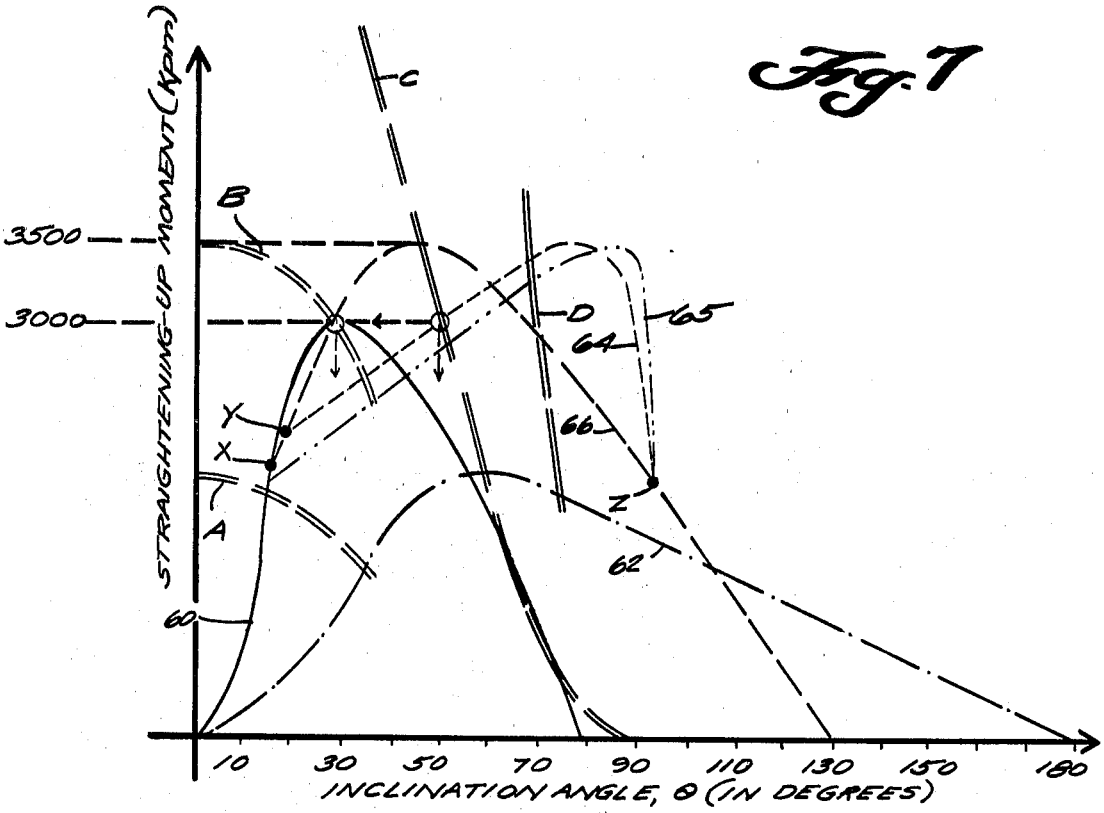
FIGS. 7 and 8 graphically illustrate the stability of a trimaran according to the present invention compared to a conventional trimaran and keelboat, and the heeling effective of different wind strengths.
Figure 8:
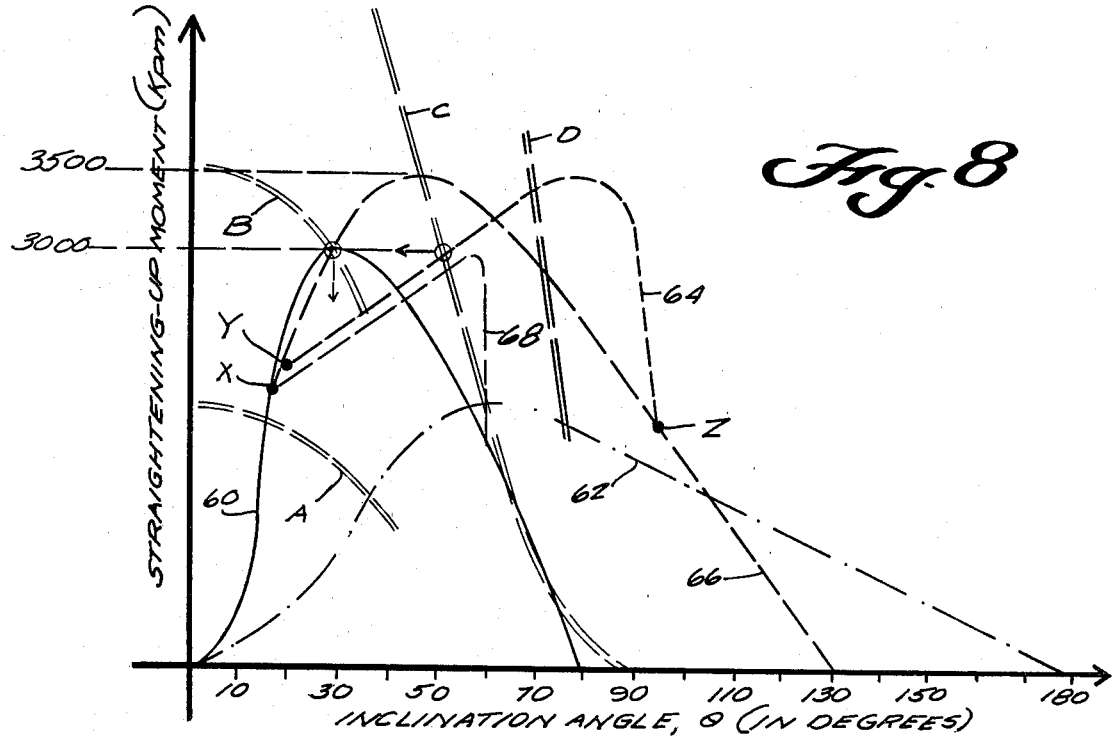

FIGS. 7 and 8 graphically illustrate improved results obtainable according to the present invention. FIGS. 7 and 8 illustrate the stability curves for various sailboats. The stability curves provided in FIGS. 7 and 8 are based on two actual tests, and on theoretical calculations. The vertical axis of each graph shows the straightening-up moment, while the horizontal axis gives the angle of inclination, $\theta$, in degrees. The graphs provide comparative information for a conventional trimaran, a keelboat (an "average" stability curve has been chosen for a keelboat), and a trimaran according to the present invention. All boats are basically comparable in size and construction. The maximum stability for a 1500 kilogram conventional trimaran was 300 kpm, and 3500 kpm for a corresponding trimaran according to the present invention.

Curve 60 in FIGS. 7 and 8 is the stability curve for a conventional trimaran. Curve 62 in FIGS. 7 and 8 is the stability curve for a corresponding keelboat. Two different curves are provided for each of two different types of boats according to the present invention. The first type of boat according to the present invention is that illustrated in FIG. 2, while the second type is that illustrated in FIG. 5 (with springs 45, 46 associated with shrouds 39, 40). Curve 64 indicates the mast inclination of the FIG. 2 embodiment according to the present invention, while curve 65 illustrates the mast inclination of the FIG. 5 embodiment. Curve 66 illustrates the inclination of the main hull for both the FIG. 2 and FIG. 5 embodiments.

A curve indicating the tilting effect of the wind, abbreviated VKV, is also illustrated in FIGS. 7 and 8 for each of four different wind conditions. Curve A corresponds to normal fresh winds, wherein the pivotal movement of the side hulls 12, 14 of the trimaran according to the present invention would not take place. Curve B indicates very fresh winds where some side movement takes place. Curve C indicates extremely hard winds, while curve D indicates exceptionally hard winds (may be unrealistically hard). The various values of the inclination and straightening-up moment can thus be seen in FIGS. 7 and 8 for each of these wind conditions.

Figure 5:
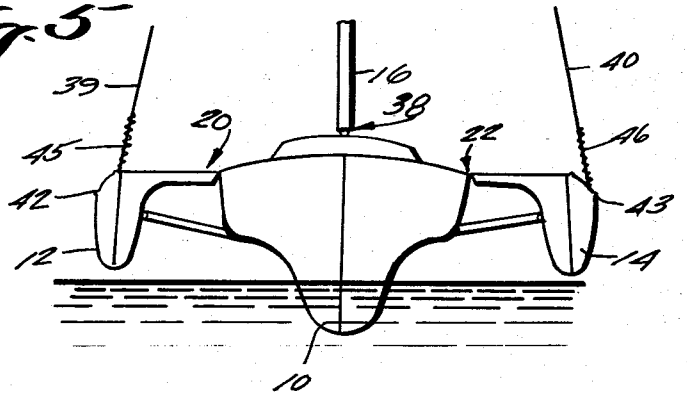
FIG. 5 is a front view of a modified form of a trimaran according to the present invention.

FIG. 8 is the same as FIG. 7 except instead of containing curve 65 which illustrates mast inclination for the FIG. 5 embodiment according to the present invention, it provides a curve 68 which corresponds to mast inclination for a trimaran having a pivotal mast only.

In evaluating the curves in FIGS. 7 and 8, when considering the risk of capsizing due to waves, the curve corresponding to the angle of inclination of the main hull of the trimaran according to the present invention is of interest—that is, curve 66. Due to the pre-tensioning of the spring devices 26, and the utilization of the stops 29, 30 according to the present invention, the curves 60 and 66 are coincident up to the point X in FIGS. 7 and 8, where the leeward side hull starts to move up. At point Y the windward side hull starts to move up, and thus the mast 16 starts to incline relative to the main hull 10. At the point Z the mast 16 has again straightened-up in relation to the main hull 10, and the curves 64, 65 for the two different types of trimarans according to the present invention come back together.

During actual test sailing with a prototype of the trimaran according to the present invention, special trials were made with one side "elastic", the pivotal connections between the side hull and the main hull, and the pivotal connection of the mast, being provided on that side, while the other side was fixed. It was readily apparent that when the boat heeled over to the elastic side the sailing comfort became considerably better in a choppy sea. Large waves caused the side hull to move up instead of turning the whole boat sideways. Elasticity also ensured that the boat was not exposed to the same chock loads, important for preventing structural damage (brake up) in the ocean.

The following table also facilitates a comparative analysis between a trimaran according to the present invention and other types of boats. In the table, the designations A, B, C, and D correspond to wind strengths as described above with respect to FIGS. 7 and 8. The boat Type 1 is the boat constructed according to Swedish Pat. No. 383,497. The boat Type 2 is constructed according to French Pat. No. 1,505,692. The boat Type 3(*a*) is a boat according to the FIG. 2 embodiment of the present invention. The boat Type 3(*b*) is according to the FIG. 5 embodiment of the present invention. The boat Type 4 is a conventional trimaran. The numerical values given in the table are the inclination angle $\theta$ for the main hull 10, in degrees:

| | A | B | C | D |
|---|---|---|---|---|
| Type 1 | 15 | 20 | 24 | capsized |
| Type 2 | 15 | 28 | 45 | 70 |
| Type 3(a) | 15 | 23 | 28 | 37 |
| Type 3(b) | 15 | 21 | 26 | 33 |
| Type 4 | 15 | 27 | 66 | capsized |

The marked improvement in stability of the trimaran according to the present invention is readily apparent from the above tabular compilation, and from the graphical representations in FIGS. 7 and 8.

It will thus be seen that according to the present invention a trimaran has been provided having a minimized angle of inclination for a given wind force, positive stability being maintained for up to about 130° inclination of the main hull, the trimaran being self-righting.

While the invention has been herein shown and described in what is presently conceived to be the most practical and preferred embodiment thereof, it will be apparent to those of ordinary skill in the art that many modifications thereof may be made within the scope of the invention, which scope is to be accorded the broadest interpretation of the appended claims so as to encompass all equivalent structures and devices.

What is claimed is:

1. A trimaran comprising: an elongated main hull, a starboard hull, and a port hull, the starboard and port hulls disposed on opposite sides of said main hull and parallel thereto; a mast; stays extending between said mast and said main hull for stabilizing the position of said mast with respect to said main hull; and means for operatively attaching said starboard and port hull to said main hull, for operatively attaching said mast to said main hull, and for operatively attaching said mast to said starboard and port hulls, so that the angle of inclination of said main hull is minimized and so that the trimaran is self-righting; said means for operatively attaching said starboard and port hulls to said main hull comprising means for pivotally mounting each of said starboard and port hulls to said main hull along a side of said main hull so that said starboard and port hulls are pivotal about an axis generally parallel to the direction of elongation of said main hull; said means for operatively attaching said mast to said main hull comprising means for pivotally mounting said mast to said main hull so that it is pivotal about an axis substantially parallel to the axes about which said starboard and port hulls are pivotal; and said means for operatively attaching said mast to said starboard and port hulls comprising shroud means.

2. A trimaran as recited in claim 1 wherein said means for operatively attaching said starboard and port hulls to said main hull further comprise resilient means for applying a force to said starboard and port hulls, respectively, of sufficient magnitude to prevent substantial pivotal movement thereof about their axes in normal fresh winds, while providing pivotal movement thereof about their axes, and thus pivotal movement of said mast about its axis, in winds stronger than normal fresh winds, the force applied by said resilient means increasing as said starboard and port hulls pivot about their axes.

3. A trimaran as recited in claim 2 wherein said resilient means comprise, for each of said starboard and port hulls, at least one spring device pivotally connected at one end thereof to said main hull and at the other end thereof to said starboard or port hull, and a stop means for stopping the movement of said starboard or port hull towards said main hull at a predetermined desired position.

4. A trimaran as recited in claim 3 wherein said stop means each comprise a pair of telescopic rods, one pivotally mounted at one end thereof to said main hull, and the other pivotally mounted at one end thereof to said starboard or port hull, with the opposite ends of the rods telescopically engaging with each other.

5. A trimaran as recited in claims 1 or 2 wherein said shroud means comprises at least one shroud extending from a top portion of said mast to each of said starboard and port hulls, and means for providing variation in the length of each of said shrouds during relative movement of said mast with respect to said main hull.

6. A trimaran as recited in claim 5 wherein said means for providing variation in the length of each shroud comprises a resilient device operatively attached to each shroud and applying a force tending to provide a given predetermined length of each shroud plus resilient device.

7. A trimaran comprising an elongated main hull;

a starboard hull pivotally mounted to said main hull along the starboard side thereof, so that it is pivotal with respect to said main hull about an axis generally parallel to the direction of elongation of said main hull;

a port hull pivotally mounted to said main hull along the port side thereof, so that it is pivotal with respect to said main hull about an axis substantially parallel to the direction of elongation of said main hull;

a mast mounted to said main hull for pivotal movement about an axis substantially parallel to the axes about which said starboard and port hulls are pivotal;

a pair of stays extending from a top portion of said mast to said main hull for stabilizing the position of said mast; and a pair of shrouds, one extending from a top portion of said mast to each of said starboard and port hulls, respectively.

8. A trimaran as recited in claim 7 further comprising resilient means for applying a force to said starboard and port hulls, respectively, of sufficient magnitude to prevent substantial pivotal movement thereof about their axes in normal fresh winds.

9. A trimaran as recited in claim 8 wherein said resilient means comprise, for each of said starboard and port hulls, at least one spring device pivotally connected at one end thereof to said main hull and at the other end thereof to said starboard or port hull, and a stop means for stopping the movement of said starboard or port hull towards said main hull at a predetermined desired position.

10. A trimaran as recited in claims 7 or 8 further comprising a spring means connected to each of said shrouds for providing variation in the effective length of each shroud in response to mast pivoting.

* * * * *